United States Patent [19]

Buckle et al.

[11] Patent Number: 4,499,694

[45] Date of Patent: Feb. 19, 1985

[54] CYCLIC SHEAR ENERGY ABSORBER

[75] Inventors: Ian G. Buckle; Steven M. Built, both of Auckland, New Zealand

[73] Assignee: Development Finance Corporation of New Zealand, Wellington, New Zealand

[21] Appl. No.: 504,725

[22] Filed: Jun. 16, 1983

[30] Foreign Application Priority Data

Jun. 18, 1982 [NZ] New Zealand ..... 201015

[51] Int. Cl.[3] ..... E04B 1/98

[52] U.S. Cl. ..... 52/167; 52/573

[58] Field of Search ..... 52/167, 393, 573; 14/16.1; 248/213

[56] References Cited

U.S. PATENT DOCUMENTS 3,544,415 12/1970 Price et al. ..... 14/16.1 X
3,924,907 12/1975 Czernik et al. ..... 14/16.1 X
4,117,637 10/1978 Robinson ..... 52/167
4,121,393 10/1978 Renault et al. ..... 52/167

*Primary Examiner*—Carl D. Friedman
*Assistant Examiner*—Naoko Slack
*Attorney, Agent, or Firm*—Holman & Stern

[57] ABSTRACT

A cyclic shear energy absorber for absorbing energy due to induced motion between two members by plastic cyclical deformation of a central energy absorber core. The core is surrounded by a restraining device having movable inner walls, preferably in the form of a deformable cylinder wound from a strip of material having a rectangular cross section. The restraining element is confined in a cylindrical aperture formed in a resilient support having alternately arranged resilient layers and stiffener layers. The absorber is confined between two end plates capable of being coupled to associated structural members, such as a bridge support column and a base.

21 Claims, 6 Drawing Figures

CYCLIC SHEAR ENERGY ABSORBER

BACKGROUND OF THE INVENTION

This invention relates to energy absorbers used in conjunction with large structures to reduce the influence of externally induced motion on such structures.

Cyclic shear energy absorbing devices are known which employ the cyclic plastic deformation of certain materials beyond the elastic limit for the absorption of kinetic energy. Such absorbing devices are typically interposed between a building support member and a base member, or between two structural support members, in order to convert portions of the kinetic energy into heat in the absorbing material and thus reduce the motion imparted to the structure by externally induced forces, such as an earthquake or high winds. U.S. Pat. No. 4,117,637 issued Oct. 3, 1978, to Robinson for "Cyclic Shear Energy Absorber", the disclosure of which is hereby incorporated by reference, illustrates several geometrical configurations of the basic cyclic shear energy absorber device. The basic device includes a pair of spaced coupling members, typically plates, each one of which is designed to be coupled to an individual structural member. When used in a building environment, for example, one of the coupling members is configured to be attached to a support piling, while the other coupling member is configured to be attached to a support pillar, beam or the like. Arranged between the two coupling members is a solid plastically cyclically deformable mass of material, typically lead, which provides the energy absorption function. Some configurations of this type of device further include an additional resilient pad structure which surrounds the energy absorbing mass and provides resilient vertical support between the two coupling members, usually by means of a sandwich comprising alternate layers of a resilient material (e.g. rubber) and a stiffener material (e.g. steel, aluminum or the like).

In use, when externally induced forces result in relative lateral motion between the two coupling members, the solid energy absorbing mass is cycled beyond its elastic limit, converting some of the energy into heat and storing the remaining energy when the mass is in the deformed state, the latter acting as a driving force which tends to return the material to its original mechanical properties. As a consequence, the energy transmitted to or through the structure is converted into heat rather than being applied in a destructive fashion to the building. Consequently, structures incorporating such absorbers have a higher safety factor than those relying on the ductile behavior of structural members to dissipate energy (which will be damaged by a severe earthquake and will be difficult to repair or replace), and those using rubber dampers, (which function in a spring-like fashion and dissipate only small amounts of externally imparted energy).

While cyclic energy absorbers of the above type have been found to function well in many applications, in some applications premature degradation of the energy absorbing mass after a small number of oscillations has been observed.

This is due to a lack of confinement about the absorber mass which is free to elongate in a direction normal to that of the imposed deformation and thereby reducing its effectiveness as an energy absorber. Even in those applications in which the energy absorbing lead core is surrounded by a resilient support pad having sandwich construction, the degree of confinement is dependent on the magnitude of the vertical load, the elastomer hardness and the thickness of the individual layers of elastomer. Specifically, the performance of the lead core may degrade if the vertical load is less than 0.4 times the rated load of the support pad at 0.5 shear strain for an elastomer hardness index between 50 and 55 and an elastomer layer thickness of 0.5 inches. It is the object of this invention to provide an improved cyclic shear energy absorber in which this diminution in performance is eliminated.

SUMMARY OF THE INVENTION

The invention comprises an improved cyclic shear energy absorber which has an extended useful life over known energy absorbers and provides the energy absorbing advantages of the basic device.

In its broadest scope, the invention comprises a cyclic shear energy absorber for absorbing energy due to induced motion between two members, the energy absorber including first and second coupling means adapted to be coupled to first and second members, such as a support column for a building and a support piling, a plastically cyclically deformable energy absorber means coupled between the first and second coupling means, and a restraining means disposed about the energy absorber means in the region between the first and second coupling means. The restraining means has a flexible wall surface for confining the energy absorber means during induced motion between the two members while permitting the energy absorber means to physically deform in the desired fashion. In a preferred embodiment of the invention, the restraining means comprises a flat member generally spirally wound about the outer surface of the energy absorber means, the flexible wall surface being afforded by the individual winding layers each slidably engaged with adjacent layers.

The restraining means is preferably surrounded by a resilient support arranged between the first and second coupling means, the resilient support preferably comprising alternate layers of a resilient material such as rubber and a stiffener material, such as steel, aluminum or fiberglass.

In the preferred geometry, the energy absorbing means comprises a cylindrical core captured between the facing surfaces of the first and second coupling means, the restraining means is a helically wound flat spiral, and the resilient support comprises rectangular or square layers of rubber and steel having a cylindrical aperture through the center for receiving the restraining means and the core.

The invention is fabricated by assembling the resilient support, inserting the restraining means preferably with the aid of a guide fixture, such as a mandrel having a diameter substantially equal to the desired inner diameter of the restraining means, and placing the energy absorber core within the restraining means. The core may be inserted within the restraining means by either press fitting the core into the hollow interior of the restraining means or by casting the core into the interior of the restraining means.

In use, when the two coupling means are subjected to vibrations causing lateral displacement, the resilient support, restraining means and energy absorbing core follow this motion. The restraining means permits the energy absorbing core to plastically deform while at the same time confining the core in such a manner as to avoid any excessive mechanical abrading of the core material.

For a fuller understanding of the nature and advantages of the invention, reference should be had to the ensuing detailed description taken in conjunction with the accompanying drawings.

DESCRIPTION OF THE PREFERRED EMBODIMENTS

Figure 1:
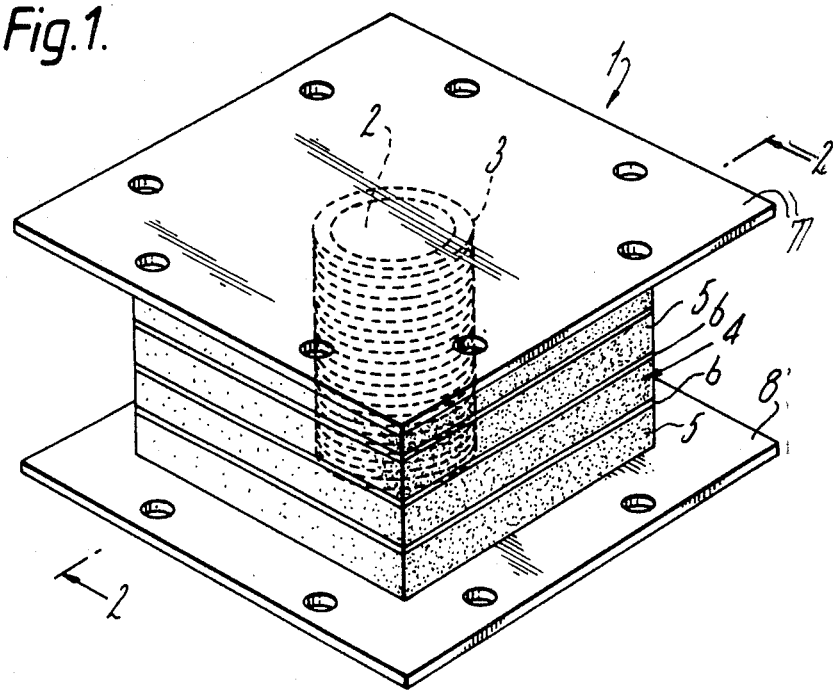
FIG. 1 is a perspective view of a preferred embodiment of the invention.

Turning now to the drawings, FIG. 1 illustrates a preferred embodiment of the invention in perspective. As seen in this Fig., the energy absorbing device includes a central energy absorbing core 2 having a cylindrical shape, a flexible restraining means 3 surrounding the core 2, a resilient support 4 and top and bottom coupling plates 7, 8, respectively.

Figure 2:
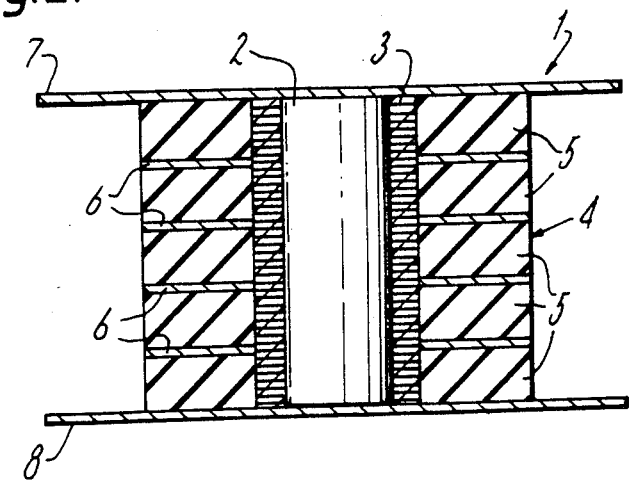
FIG. 2 is a sectional view taken along lines 2—2 of FIG. 1.

As best seen in FIG. 2, the resilient support pad 4 has a sandwich-like construction consisting of alternate layers of a resilient material 5, preferably and elastomeric material such as natural or synthetic rubber, and stiffener plates 6, preferably fabricated from steel, aluminum, fiberglass, fabric or other suitable stiffener materials. Resilient support 4 functions as a bearing pad for transferring vertical loads through the device, and support 4 is typically mounted between the bottom of a vertical support beam, attached to or resting on the upper plate 7, and a support piling, attached to or engaged with bottom plate 8. The individual layers 5, 6 are typically bonded to one another to form a unitary structure, most commonly by vulcanization.

The restraining element 3 is preferably a spirally wound cylindrical structure made from a suitable strip material having a rectangular cross-section. Suitable materials comprise spring steel, mild steel, aluminum strip and any other material capable of being wound to the spiral shape shown.

The energy absorbing core 2 is preferably fabricated from high quality lead formed to the cylindrical shape illustrated. The term high quality lead is meant to imply lead having a purity of 99.9 percent. In many applications, lead having a slightly lower purity, down to about 98 percent may be employed. Other suitable materials are those noted in the above-referenced U.S. Pat. No. 4,117,637 and any equivalents having comparable cyclic plastic deformation characteristics.

The device shown in FIGS. 1 and 2 is preferably fabricated in the following manner. Resilient support 4 is first constructed by forming the individual elements to the square shape illustrated, or some other suitable geometrical configuration, with the central circular apertures aligned to form a cylindrical void generally at the center of the support 4. Thereafter, the restraining element 3 is inserted into this aperture, preferably with the aid of a cylindrical mandrel. Thereafter, the energy absorbing core 2 is press fitted into the interior of the restraining element, after which the top and bottom plates are arranged as shown. It has been found that best results are obtained, when using high quality lead for the energy absorber element 2, by first casting the cylindrical absorber and then press fitting the absorber into the restraining element 3. The size of the cylindrical absorber element 2 should be slightly undersized along the outer diameter with respect to the inner diameter of the element 3 so that the absorber element 2 provides a sliding fit with the interior surface of the restraining element 3. In addition, the cylindrical absorber element 2 should be slightly longer than the axial length of the completed device. When casting the energy absorber element 2, the inner diameter of the mold should be essentially the same as the inner diameter of the cylindrical aperture formed in the resilient support 4.

If desired, the energy absorber core element 2 may be cast in place within the cylindrical volume of the restraining element 3. When employing this alternative method of fabricating the device, the thermal expansivity of lead must be taken into account when pouring the molten core to assure that shrinkage of the core during the subsequent cooling does not result in excessive voids between the outer surface of the core element 2 and the inner surface of the restraining element 3. For best results care should be taken to ensure that core element 2 is totally confined on all surfaces, i.e. about the cylindrical side wall surface and on the top and bottom surfaces.

Figure 3:
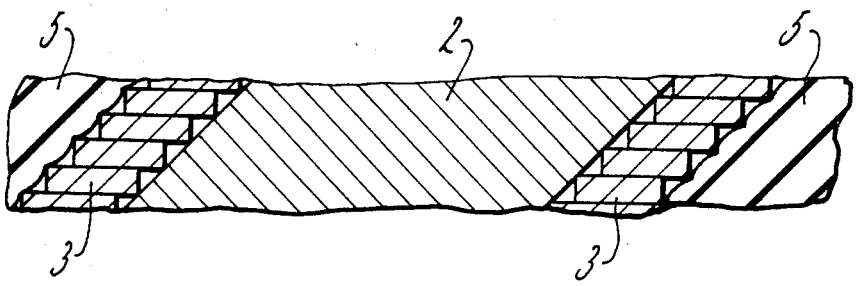
FIG. 3 is an enlarged diagrammatic sectional view illustrating operation of the restraining means.

In operation, the device is installed between a support member for a structure, such as a bridge or a building and a base, such as a foundation pad. When a structure is subject to induced vibrations from an earthquake, high winds or the like, which result in shear forces transmitted to the energy absorber device, the device is subjected to these shear forces and distorts in the manner illustrated in FIG. 3. As seen in this Fig., the core element 2 has deformed from its normal right circular cylindrical shape in response to the shear forces, and the restraining element 3 follows the same motion. Due to the rectangular cross-sectional configuration of the restraining element 3, adjacent layer windings are slidably translated from their normal vertical alignment illustrated in FIG. 2 to the displaced configuration shown in FIG. 3. However, sufficient surface area exists between adjacent layers to provide vertical support to prevent collapse of the restraining element 3, or distortion of this element, in combination with the surrounding resilient layers 5, so that the core element 2 retains its generally cylindrical outline, even though the cylinder is skewed from the vertical. In addition, the flexibility of the wall surface afforded by the inner surfaces of the individual winding layers of restraining element 3 and the slidable arrangement for the adjacent layers, permits the core element 2 to deform sufficiently to dissipate energy while preserving the integrity of the core element. As noted above, most of the energy is dissipated by heat generated in the core element 2, while the remaining energy is stored in both the element 2 and the resilient support 4. This stored energy is used to return the material of the core to its original mechanical state. In addition, release of that portion of the energy stored in the resilient support 4 will tend to return core element 2 to its original geometrical configuration illustrated in FIG. 2.

Actual tests conducted on energy absorber devices fabricated according to the teachings of the invention have shown that the useful lifetime of the improved energy absorber device is much greater than a similar device constructed according to the prior art but lacking the restraining element 3.

Specifically, the results of a research program recently completed at the University of Auckland in New Zealand are described in the following publications.

References

1. King, P. G. "Mechanical energy dissipators for seismic structures", Department of Civil Engineering Report No. 228, University of Auckland, August 1980.
2. Built, S. M. "Lead-rubber dissipators for the base isolation of bridge structures", Department of Civil Engineering Report No. 289, University of Auckland, August 1982.

To summarize the results, twenty 15 inch×12 inch×4 inch lead-filled elastomeric bearings with 5, one-half inch internal layers, were dynamically tested for a wide range of vertical loads and shear strain amplitudes. Five cycles of displacement were imposed to each of 25 combinations of vertical load and shear strain. Dissipated energy was measured from the area of the load-deflection hysteresis loops together with the characteristic yield strengths, and the elastic and post-elastic stiffnesses. Various unconfined lead configurations were investigated and the results compared with tests on lead cylinders confined in the manner described above. Built (1982) describes the results of the particular tests where it is typically shown that the energy dissipated per cycle was more than doubled when the lead cylinder was confined.

Figure 4:
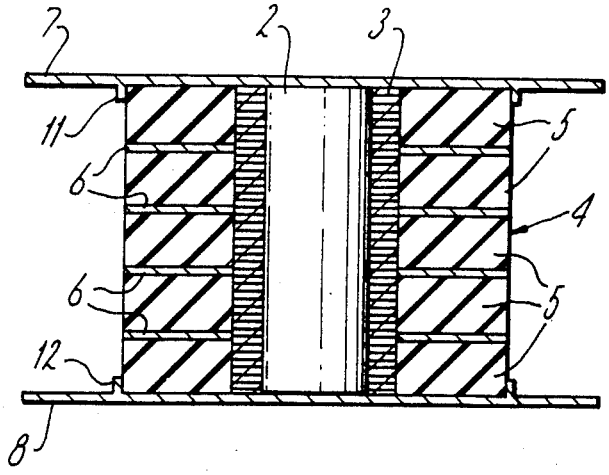
FIG. 4 is a sectional view similar to FIG. 2 illustrating an alternate embodiment of the invention.

In many applications, the frictional force between the lower surface of upper plate 7 and the abutting surface of upper layer 5, and the frictional force between the upper surface of lower plate 8 and the abutting surface of adjacent resilient layer 5 are sufficient to provide the shearing action described above and partially illustrated in FIG. 3. In some applications, it may be desirable to provide additional coupling between the plates 7, 8 and the interposed resilient support 4. One technique for providing this additional coupling comprises bonding the plates 7, 8 to the end surfaces of the resilient support 4, e.g. by vulcanization, adhesives or the like. In other applications, it may be desirable to provide additional engagement between the plates 7, 8 and the resilient support 4. FIG. 4 illustrates a first alternate embodiment of the invention in which a positive engagement force is provided between the plates 7, 8 and the resilient support 4. As seen in this Fig., the lower surface of upper plate 7 is provided with an abutment collar 11 having the same geometrical configuration as the outer perimeter of resilient support 4 (shown as rectangular in FIG. 1). Collar 11 is configured and dimensioned in such a manner that the upper most portion of resilient support 4 can be received within the collar 11 when plate 7 is lowered onto the resilient support 4. Bottom plate 8 is provided with a similar abutment collar 12 on the upper surface thereof, collar 12 being dimensioned and configured substantially identical with collar 11. In use, lateral displacement between plates 7 and 8 is transmitted to the resilient support 4 not only by the frictional forces between the plates 7, 8 and the support 4 but also positively by means of the mechanical force between the collars 11, 12 and the support 4. Collars 11, 12 may be secured to plates 7, 8 in any suitable fashion, such as by welding, brazing, adhering or the like.

Figure 5:
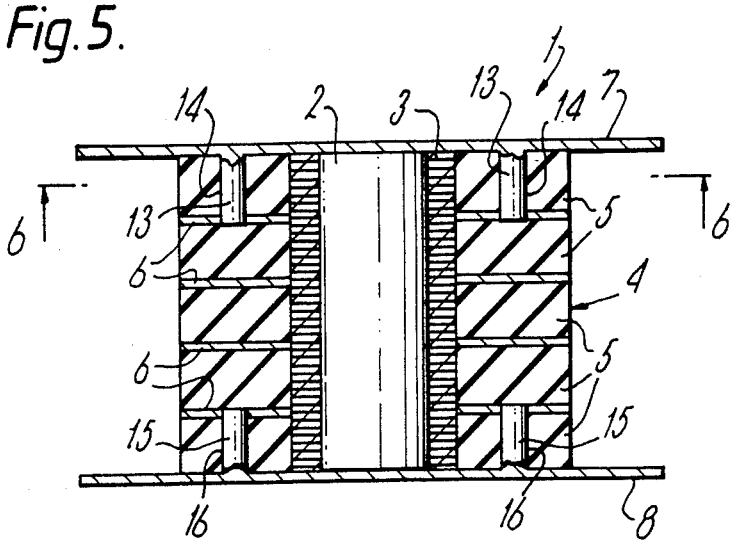
FIG. 5 is a sectional view similar to FIG. 4 illustrating another alternate embodiment of the invention.
Figure 6:
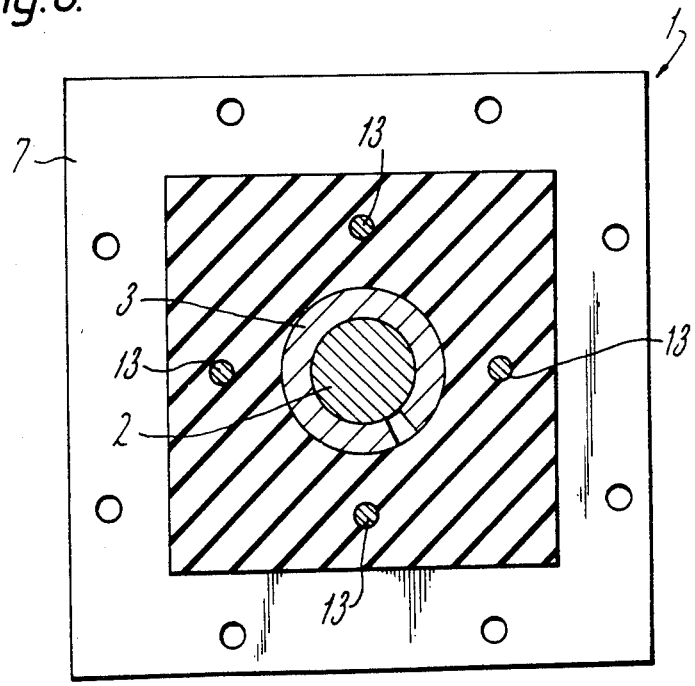
FIG. 6 is a plan view taken along lines 6—6 of FIG. 5.

FIGS. 5 and 6 illustrate an alternate embodiment of the invention also providing a positive engagement between the plates 7, 8 and the resilient support 4. As seen in these Figs., upper plate 7 is provided with a plurality of downwardly depending dowel pins 13 arranged in a predetermined pattern, illustrated as a circular pattern of four pins 13 spaced by ninety degrees about the center axis of the core element 2. A corresponding plurality of apertures 14 are similarly preformed in the upper most resilient layer 5 and the upper most stiffener plate 6. The apertures 14 may extend entirely through the upper most stiffener plate 6 or only partially through the plate. The arrangement of the pins 13 and the apertures 14 is such that the pins 13 may be pressed down into the apertures 14 as the top plate 7 is lowered onto the resilient support 4. Lower plate 8 is provided with a similar arrangement of dowel pins 15, and lower most resilient layer 5 and lower most stiffener plate 6 are provided with corresponding apertures 16.

Although the preferred embodiments have been illustrated as preferably incorporating upper and lower plates 7, 8, in some applications these plates may be incorporated into the associated structural members, or the function of the plates 7, 8 may be provided by surfaces defined by the associated structural members. For example, lower plate 8 may comprise the upper surface of a concrete support pad for a power plant, while upper plate 7 may be the bottom of the containment housing for the power plant. Other variations will occur to those skilled in the art.

While the above provides a full and complete disclosure of the preferred embodiment of the invention, various modifications, alternate constructions and equivalents may be employed without departing from the true spirit and scope of the invention. For example, while right circular cylindrical geometry has been specifically described for the preferred embodiment, other geometries may be employed, such as rectangular, trapezoidal, elliptical, and the like. Further, while the resilient support 4 has been disclosed as having rectangular geometry, other geometrical configurations may be used for this compound element as well, including circular geometry. In addition, while the restraining element has been described with reference to a flat spirally wound cylinder, other configurations may be employed, depending on the geometry of the core element 2. For example, if a rectangular core element is employed, the restraining element will have a similar rectangular geometry. Moreover, if desired the restraining element may comprise individual elements (circular flat rings, rectangular flat frames, or the like) arranged in a vertical stack, so long as each individual element is slidably arranged with respect to the flanking elements in the stack. Therefore, the above description and illustrations should not be construed as limiting the scope of the invention, which is defined by the appended claims.

What is claimed is:

1. In a cyclic shear energy absorber adapted to be interposed between two members for absorbing energy due to induced motion between said two members, said energy absorber including a first end portion engageable to one of said two members, a second end portion engageable to the other one of said two members, and plastically cyclically deformable energy absorber means extending between said first and second end portions, the improvement comprising restraining means disposed about said energy absorber means in the region between said first and second portions, said restraining means having a flexible wall surface for confining said energy absorber means during induced motion between said two members while permitting said energy absorber means to deform.

2. The improvement of claim 1 wherein said restraining means comprises a flat member generally spirally wound about the outer surface of said energy absorber means, said flexible wall surface being formed by the individual winding layers each slidably engaged with the adjacent layers.

3. The improvement of claim 1 further including a resilient support surrounding said restraining means and arranged between said first and second end portions.

4. The improvement of claim 1 wherein said energy absorber means comprises a lead core.

5. The improvement of claim 1, further including an upper plate member coupled to said first end portion and a lower plate member coupled to said second end portion.

6. The improvement of claim 3 wherein said resilient support comprises alternate layers of resilient material and stiffener material.

7. The improvement of claim 3 further including an upper plate member coupled to said first end portion and a lower plate member coupled to said second end portion, and wherein at least one of said upper and lower plate members includes abutment means for transferring forces between said plate member and the associated end portion.

8. The improvement of claim 6 further including an upper plate member coupled to said first end portion and a lower plate member coupled to said second end portion, and wherein at least one of said upper and lower plate members includes abutment means for transferring forces between said plate member and said energy absorber means, said resilient support having a plurality of longitudinally extending apertures formed therein extending from the end portion thereof adjacent at least one plate member, and said abutment means comprising a corresponding plurality of dowel members each received in an associated one of said plurality of apertures.

9. The improvement of claim 7 wherein said end portion has a rectangular perimeter and said abutment means comprises a rectangular shoulder surrounding said perimeter.

10. A cyclic shear energy absorber for absorbing energy due to induced motion between two members, said energy absorber comprising:

first coupling means adapted to be coupled to a first one of said two members;

second coupling means adapted to be coupled to the other one of said two members;

plastically cyclically deformable energy absorber means coupled between said first and second coupling means; and restraining means disposed about said energy absorber means in the region between said first and second coupling means, said restraining means having a flexible wall surface for confining said energy absorber means during induced motion between said first and second coupling means while permitting said energy absorber means to deform.

11. The combination of claim 10 wherein said restraining means comprises a flat member generally spirally wound about the outer surface of said energy absorber means, said flexible wall surface being formed by the individual winding layers each slidably engaged with the adjacent layers.

12. The combination of claim 10 further including a resilient support surrounding said restraining means and arranged between said first and second coupling means.

13. The combination of claim 10 wherein said energy absorber means comprises a lead core.

14. The combination of claim 11 wherein said flat member is fabricated from spring steel.

15. The combination of claim 12 wherein said first and second coupling means each includes abutment means for transferring forces to said resilient support.

16. The combination of claim 12 wherein said resilient support comprises alternate layers of resilient material and stiffener material.

17. The combination of claim 13 wherein said resilient material comprises rubber and said stiffener material is a metal.

18. The combination of claim 14 wherein said flat member is fabricated from aluminum.

19. The combination of claim 15 wherein said abutment means comprises a shoulder in contact with the outer periphery of said resilient support.

20. The combination of claim 16 wherein said resilient support is provided with a first plurality of apertures extending from the upper surface thereof downwardly into the uppermost layer of stiffener material and a second plurality of apertures extending from the lower surface thereof upwardly into the lower most layer of stiffener material, and wherein said abutment means includes a first plurality of dowel members extending downwardly from said first coupling means with each of said dowel members received in a corresponding one of said first plurality of apertures and a second plurality of dowel members extending upwardly from said second coupling means with each of said second plurality of dowel members received in a corresponding one of said second plurality of aperture.

21. An energy absorbing support device for a structural member, said support device comprising:

first coupling means adapted to be coupled to said structural member;

second coupling means adapted to be coupled to a base;

plastically cyclically deformable energy absorber means having a generally cylindrical shape positioned between said first and second coupling means;

generally cylindrical restraining means disposed about said energy absorber means and extending between said first and second coupling means, said restraining means having a flexible wall surface for confining said energy absorber means during induced motion between said first and second coupling means due to relative motion between the structural member and the base while permitting said energy absorber means to plastically deform; and a resilient support surrounding said restraining means and arranged between said first and second coupling means, said resilient support comprising alternate layers of a resilient material and a stiffener material.

* * * * *